US007015397B2

(12) United States Patent
Clark

(10) Patent No.: US 7,015,397 B2
(45) Date of Patent: Mar. 21, 2006

(54) MULTI-PAIR COMMUNICATION CABLE USING DIFFERENT TWIST LAY LENGTHS AND PAIR PROXIMITY CONTROL

(75) Inventor: William Clark, Lancaster, MA (US)

(73) Assignee: Belden CDT Networking, Inc., Fort Mill, SC (US)

( * ) Notice: Subject to any disclaimer, the term of this patent is extended or adjusted under 35 U.S.C. 154(b) by 0 days.

(21) Appl. No.: 10/446,518

(22) Filed: May 27, 2003

(65) Prior Publication Data

US 2004/0149484 A1 Aug. 5, 2004

Related U.S. Application Data

(60) Provisional application No. 60/445,255, filed on Feb. 5, 2003.

(51) Int. Cl.
*H01B 7/18* (2006.01)

(52) U.S. Cl. ..... 174/113 R

(58) Field of Classification Search ..... 174/113 R, 174/113 C, 131 A, 36, 27
See application file for complete search history.

(56) References Cited

U.S. PATENT DOCUMENTS

| | | | |
|---|---|---|---|
| 483,285 | A | 9/1892 | Guilleaume |
| 1,008,370 | A | 11/1911 | Robillot |
| 1,883,269 | A | 10/1932 | Yonkers |
| 1,976,847 | A | 10/1934 | Gordon et al. |
| 2,538,019 | A | 1/1951 | Lee |
| 2,882,676 | A | 4/1959 | Bryan et al. |
| 3,559,390 | A | 2/1971 | Staschewski |
| 3,603,715 | A | 9/1971 | Edhardt et al. |
| 3,644,659 | A | 2/1972 | Campbell |
| 3,649,744 | A | 3/1972 | Coleman |
| 3,819,443 | A | 6/1974 | Simons et al. |
| 3,881,052 | A | 4/1975 | Britz et al. |
| 3,911,200 | A | 10/1975 | Simons et al. |
| 4,034,148 | A | 7/1977 | Lang |
| 4,319,940 | A | 3/1982 | Arrovo et al. |
| 4,487,992 | A | 12/1984 | Tomita |
| 4,500,748 | A | 2/1985 | Klein |
| 4,595,793 | A | 6/1986 | Arrovo et al. |
| 4,605,818 | A | 8/1986 | Arrovo et al. |
| 4,647,714 | A | 3/1987 | Goto |
| 4,697,051 | A | 9/1987 | Beggs et al. |
| 4,767,891 | A | 8/1988 | Biegon et al. |
| 4,777,325 | A | 10/1988 | Siwinski |

(Continued)

FOREIGN PATENT DOCUMENTS

EP 1087410 A2 3/2001

*Primary Examiner*—Chau N. Nguyen
(74) *Attorney, Agent, or Firm*—Lowrie, Lando & Anastasi, LLP

(57) ABSTRACT

A multi-pair cable including four twisted pairs of insulated conductors each having a respective unique twist lay length, thereby providing six twist deltas between the twist lay lengths of the four twisted pairs, wherein at least five of the six twist deltas are greater than 15%. Alternatively, a multi-pair cable including a first twisted pair of conductors having a first twist lay length, and a second twisted pair of conductors having a second twist lay length that is shorter than the first twist lay length, wherein the first and second twisted pairs of conductors are in physical contact with one another along substantially an entire length of the multi-pair cable, and wherein a difference between the first twist lay length and the second twist lay length is at least 15% of the second twist lay length.

33 Claims, 4 Drawing Sheets

U.S. PATENT DOCUMENTS 4,800,236 A 1/1989 Lemke
4,912,283 A 3/1990 O'Connor
5,077,449 A 12/1991 Cornibert et al.
5,132,488 A 7/1992 Tessier et al.
5,132,490 A 7/1992 Aldissi
5,149,915 A 9/1992 Brunker et al.
5,253,317 A 10/1993 Allen et al.
5,298,680 A 3/1994 Kenny
5,313,020 A 5/1994 Sackett
5,393,933 A 2/1995 Goertz
5,399,813 A 3/1995 McNeill et al.
5,424,491 A 6/1995 Walling
5,493,071 A 2/1996 Newmover
5,514,837 A 5/1996 Kenny et al.
5,541,361 A 7/1996 Friesen et al.
5,544,270 A 8/1996 Clark et al.
5,658,406 A 8/1997 Walling et al.
5,666,452 A * 9/1997 Deitz et al. ..... 385/100
5,767,441 A 6/1998 Brorein et al.
5,789,711 A 8/1998 Gaeris et al.
5,821,466 A 10/1998 Clark et al.
5,821,467 A 10/1998 O'Brien et al.
5,834,697 A 11/1998 Baker et al.
5,883,334 A 3/1999 Newmoyer et al.
5,888,100 A 3/1999 Bofill et al.
5,936,205 A 8/1999 Newmoyer
5,952,607 A 9/1999 Friesen et al.
5,952,615 A 9/1999 Prudhon
5,956,445 A 9/1999 Deitz, Sr. et al.
5,969,295 A 10/1999 Boucino et al.
6,037,546 A 3/2000 Mottine et al.
6,074,503 A 6/2000 Clark et al.
6,150,612 A 11/2000 Grandy et al.
6,153,826 A * 11/2000 Kenny et al. ..... 174/27
6,162,992 A 12/2000 Clark et al.
6,194,663 B1 * 2/2001 Friesen et al. ..... 174/110 R
6,248,954 B1 6/2001 Clark et al.
6,255,593 B1 7/2001 Reede
6,288,340 B1 9/2001 Arnould
6,300,573 B1 * 10/2001 Horie et al. ..... 174/113 R
6,303,867 B1 10/2001 Clark et al.
6,355,876 B1 * 3/2002 Morimoto ..... 174/27
6,378,283 B1 4/2002 Barton
6,462,268 B1 10/2002 Hazy et al.
6,566,607 B1 5/2003 Walling
6,570,095 B1 5/2003 Clark et al.
6,596,944 B1 7/2003 Clark et al.
2002/0056568 A1 5/2002 Friesen et al.

* cited by examiner

MULTI-PAIR COMMUNICATION CABLE USING DIFFERENT TWIST LAY LENGTHS AND PAIR PROXIMITY CONTROL

CROSS-REFERENCE TO RELATED APPLICATIONS

This application claims priority under 35 U.S.C. § 119(e) to U.S. Provisional Application Ser. No. 60/445,255, filed Feb. 5, 2003, entitled "Multi-pair Communication Cable Using Different Twist Lay Lengths and Pair Proximity Control."

BACKGROUND

1. Field of the Invention

The present invention relates to high performance multi-pair data cables, and more particularly, to multi-pair cables using different twist lay lengths and pair proximity control to meet category six performance specifications.

2. Discussion of Related Art

As is known in the art, cables formed from twisted pairs of insulated conductors are used to transfer communication signals between, for example, components of a local area network (LAN) such as computers, telephones, and other devices. The TIA/EIA-568A specification sets out transmission requirements, such as, for example, maximum acceptable crosstalk, skew and impedance mismatch values between twisted pairs, for cables that are classified as Category 5 (Cat. 5) and category 6 (Cat. 6) cables. In order to meet these requirements various techniques are employed to control crosstalk between twisted pairs and skew.

Referring to FIG. 1*a*, there is illustrated a related art cable comprising four twisted pairs of insulated conductors 20, 22, 24, 26. Each twisted pair 20, 22, 24, 26 comprises two metallic conductors 28 each surrounded by a layer of insulation 30 and twisted together. It can be seen that due to the arrangement of the four twisted pairs 20, 22, 24, 26 there exists a central void 32 within the cable, separating non-adjacent pairs 20–26 and 22–24. According to U.S. Pat. No. 4,873,393 to Friesen et al, the twist lay length for each twisted insulated conductor pair should not exceed about forty times the outer diameter of the insulation 30 of one of the conductors 28 of the twisted pair. In addition, in order to reduce interpair crosstalk, twisted pairs with similar twist lay lengths should be located opposite one another (e.g., twisted pairs 20, 26) rather than adjacent one another (e.g., twisted pairs 20, 22). For example, the twisted pairs of the cable of FIG. 1*a* may have twist lay lengths such as shown below in Table 1.

TABLE 1

| Pair Number | Twist Lay Length (inches) |
|---|---|
| 20 | 0.350 |
| 22 | 0.680 |
| 24 | 0.770 |
| 26 | 0.380 |

As can be seen with reference to FIG. 1*a* and Table 1, the difference between the twist lays of twisted pairs 20 and 24, located adjacent one another, is 0.420 which is larger than the difference 0.090 between the twist lays of twisted pairs 22, 24, located opposite one another. In conventional cables such as the one illustrated in FIG. 1*a*, the central void 32 is relied upon to provide distance between oppositely-located twisted pairs, thereby reducing crosstalk and enabling a smaller twist delta between those pairs.

In reality, the pair arrangement in a conventional four pair cable, after assembly, is more likely to resemble the configuration shown in FIG. 1*b*. Rotational effects cause nesting of the twisted pairs, such that the central void 32*a* is substantially reduced. For this and other reasons, conventional cables such as those illustrated in FIGS. 1*a* and 1*b* may meet the requirements for Cat. 5 cables, but may not reliably meet the Cat. 6 performance requirements. In order to achieve reliable Cat. 6 cables, prior art cables generally include a central filler or cross-web (not illustrated) located in the central void 32 to further separate the twisted pairs. Alternatively, each of the twisted pairs may include an individual metallic shield disposed about the insulation layer 30.

SUMMARY OF THE INVENTION

According to one embodiment, a multi-pair cable may comprise four twisted pairs of insulated conductors each having a respective unique twist lay length, thereby providing six twist deltas between the twist lay lengths of the four twisted pairs, wherein at least five of the six twist deltas are greater than 15%.

According to another embodiment, a multi-pair cable may comprise a first twisted pair of conductors having a first twist lay length, and a second twisted pair of conductors having a second twist lay length that is shorter than the first twist lay length, wherein the first and second twisted pairs of conductors are in physical contact with one another along substantially an entire length of the multi-pair cable, and wherein a difference between the first twist lay length and the second twist lay length is at least 15% of the second twist lay length. In one example, the first and second twisted pairs may be nested to form a central core of the multi-pair cable having two interstices, and at least one dielectric filler may be disposed in one of the two interstices of the central core.

BRIEF DESCRIPTION OF THE DRAWINGS

The foregoing and other features and advantages of the present invention will be apparent from the following non-limiting discussion of various illustrative embodiments and aspects thereof with reference to the accompanying figures. It is to be appreciated that the figures are provided as examples for the purposes of illustration and explanation and are not intended as a definition of the limits of the invention. In the figures, in which like elements are represented by like reference numerals.

DETAILED DESCRIPTION

Figure 1A:
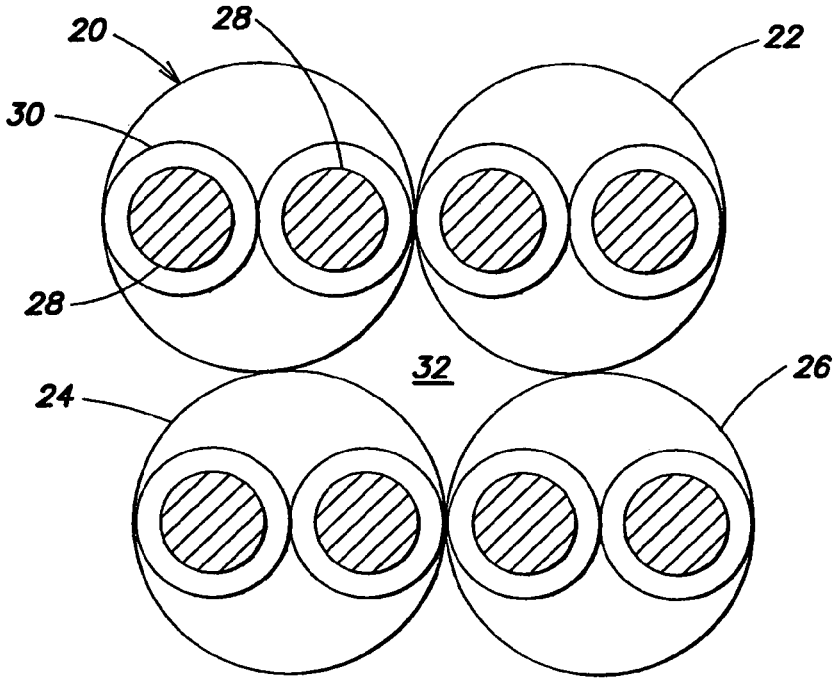
FIG. 1a (Related Art)
FIG. 1*a* is a schematic cross-sectional diagram of a related art cable.

Various illustrative embodiments and examples of the present invention and aspects thereof will now be described in more detail with reference to the accompanying figures. It is to be understood that the invention is not limited in its application to the details of construction and the arrangement of components set forth in the following description or illustrated in the drawings. Other applications, details of construction, arrangement of components, embodiments and aspects of the invention are possible. Also, it is further to be understood that the phraseology and terminology used herein is for the purpose of description and should not be regarded as limiting. As used herein, a "multi-pair cable" comprises two or more twisted pairs of insulated conductors contained within a cable jacket. The term "twist lay length" as used herein refers to the distance along the length of a twisted insulated conductor pair for a complete revolution of the individual conductors around each other, and the term "twist delta" refers to a difference in twist lay length between different twisted insulated conductor pairs within the multi-pair cable. For the purposes of this specification, an "aggressive" twist delta between two pairs is defined as a twist delta between two pairs of a cable, before cabling all the twisted pairs together, of greater than 15%, i.e., a twist lay length of one of the two twisted pairs is at least 15% larger than a twist lay length of the other of the two twisted pairs. In some embodiments, an aggressive twist delta also comprises a twist delta of greater than 15% between two pairs of a cable after cabling of the cable. Also, the term "crosstalk" refers to both Near End Crosstalk (NEXT) and Power Sum Crosstalk (PSUM NEXT), and the term "skew" refers to a difference in a phase delay added to the electrical signal for each of the plurality of twisted pairs of the multi-pair cable. In addition, the use of "including," "comprising," or "having" and variations thereof is meant to encompass the items listed thereafter and equivalents thereof as well as additional items.

Figure 2A:
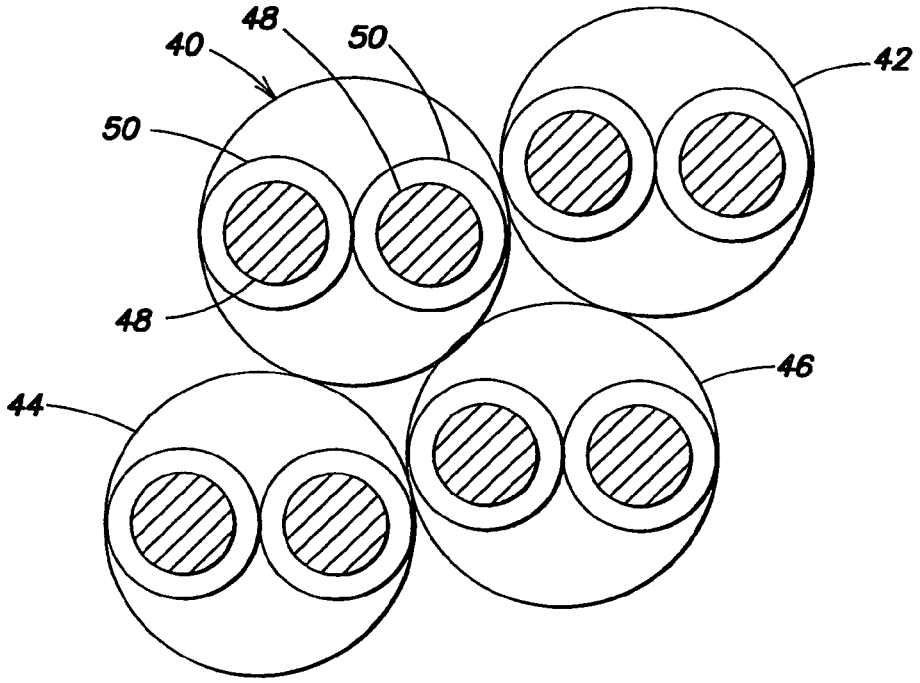
FIG. 2*a* is a schematic cross-sectional diagram of one embodiment of a cable according to aspects of the invention.

Referring to FIG. 2*a*, there is illustrated one embodiment of a multi-pair cable comprising four twisted pairs of insulated conductors 40, 42, 44, 46. Each twisted pair comprises two metallic conductors 48 each surrounded by a layer of dielectric insulation 50. Each twisted pair 40, 42, 44, 46 is twisted with a unique twist lay length. As known to those of skill in the art, twisted pairs that are in close proximity, for example adjacent twisted pairs 40 and 42, should have dissimilar twist lay lengths in order to reduce crosstalk between those pairs. However, the twist lay length of a twisted pair affects the signal phase delay provided by the twisted pair, i.e., the amount of phase added to a signal as it travels though one of the twisted pairs of the cable. As mentioned above, the term "skew" refers to a difference in a phase delay added to the electrical signal for each of the plurality of twisted pairs of the multi-pair cable. A skew results from the fact that a twisted pair having a relatively short twist lay length has a longer "untwisted" length compared to a twisted pair having a relatively long twist lay length, and thus the amount of time taken for a signal to travel through a twisted pair having a relatively short twist lay length is longer than the amount of time taken for a signal to travel through a twisted pair having a relatively long twist lay length. The Cat. 6 specification requires a multi-pair cable to have an overall skew of less than about 45 nanoseconds (ns) per 100 meters (m) over a frequency range of approximately 0.77 Megahertz (MHz) to 250 MHz. Thus, the limit on tolerable skew places a limit on the "twist lay range" of a cable, .i.e., the difference between the shortest twist lay length and the longest twist lay length of twisted pairs within the cable.

According to one embodiment, the twisted pairs of the multi-pair cable of FIG. 2*a* may have pre-cabling twist lay lengths as shown in Table 2 below. Those of skill in the art will appreciate that the twist lay lengths of the twisted pairs may be varied by a "cable twist lay length" when the plurality of twisted pairs are cabled together and jacketed to form the overall cable. If the twisted pairs are cabled in the same direction as they are twisted, the post-cabling, or final, twist lays lengths will be shorter than those given in Table 2, whereas if the twisted pairs are cabled in the opposite direction to which they are twisted, the final twist lay lengths will be longer than those given in Table 2, according to the equation:

$$\frac{1}{\text{Final_lay_length}} = \frac{1}{\text{Twist_lay_length}} \pm \frac{1}{\text{Cable_lay_length}} \tag{1}$$

Of course it is also to be appreciated that the values given in Table 2 are simply examples and a cable may be constructed according to the principles of the invention using different twist lay lengths for each twisted pair. Such twist lay lengths can be readily determined by one of skill in the art based on this disclosure.

TABLE 2

| Twisted Pair | Twist Lay Length (inches) |
|---|---|
| 40 | 0.394 |
| 42 | 0.809 |
| 44 | 0.551 |
| 46 | 0.898 |

Figure 1B:
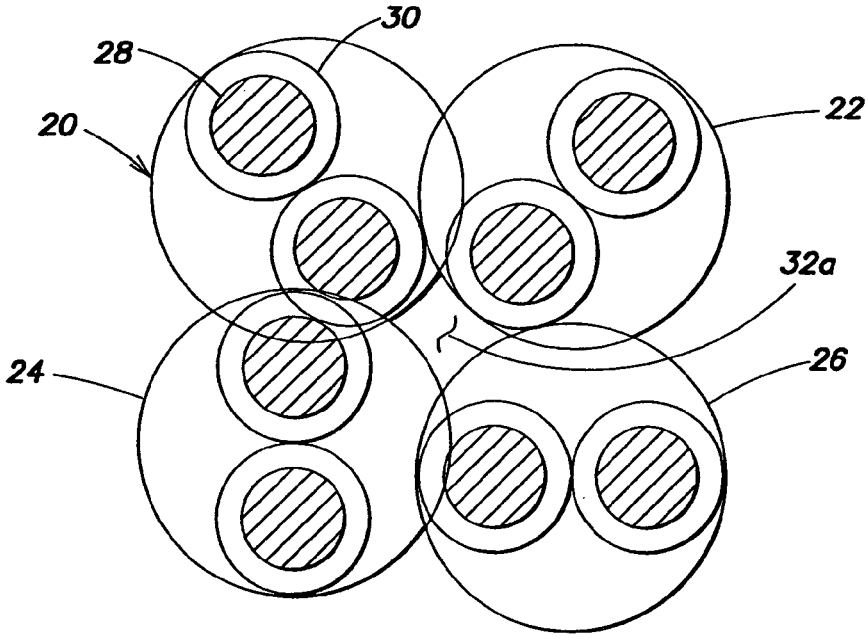
FIG. 1b (Related Art)
FIG. 1*b* is a schematic cross-sectional diagram of a related art cable.

In contrast to the conventional cable illustrated in FIGS. 1*a* and 1*b*, according to one embodiment of the invention, illustrated in FIG. 2*a*, the twisted pairs may be arranged such that twisted pairs 40, 46 are nested and the central void present in a conventional cable (FIG. 1*a*, 32) is removed. As a result, there should be a larger twist delta between twisted pairs 40 and 46, whereas in the conventional cable of FIG. 1*a*, the twist delta between pairs 20 and 26 may be smaller because the pair-to-pair separation provided by the central void 32 may be relied upon to reduce crosstalk. As mentioned above, an "aggressive" twist delta between two pairs is defined as a twist delta of greater than 15%, at least pre-cabling of the twisted pairs and in some embodiments post cabling of the twisted pairs, i.e., a twist lay length of one of the two twisted pairs is at least 15% larger than a twist lay length of the other of the two twisted pairs. This definition of aggressive twist delta applies to pre-cabled twist lay lengths of the twisted pairs, such as those given in Table 2, and in certain embodiments may also apply to post-cabling (final) twist lay lengths. The remaining twisted pairs 42, 44 rest within the interstices provided by twisted pairs 40, 46, as illustrated.

In a four-pair cable there are six possible combinations of pairs and thus six twist deltas. As discussed above, a conventional cable, such as illustrated in FIGS. 1*a* and 1*b*, may include four aggressive twist deltas between adjacent twisted pairs and two weaker twist deltas between opposite pairs. For the purposes of this specification, a "weaker" twist delta is defined a twist delta of less than 15%. By contrast, according to one embodiment of the invention, the multi-pair cable may comprise five aggressive twist deltas between pairs 40 and 42, 40 and 44, 40 and 46, 42 and 46, and 44 and 46. A weaker (smaller) twist delta may be provided between pairs 42 and 44 because the twisted pairs 40 and 46 may serve both to physically separate pairs 42 and 44 and to act as an isolation shield between pairs 42 and 44.

Figure 2B:
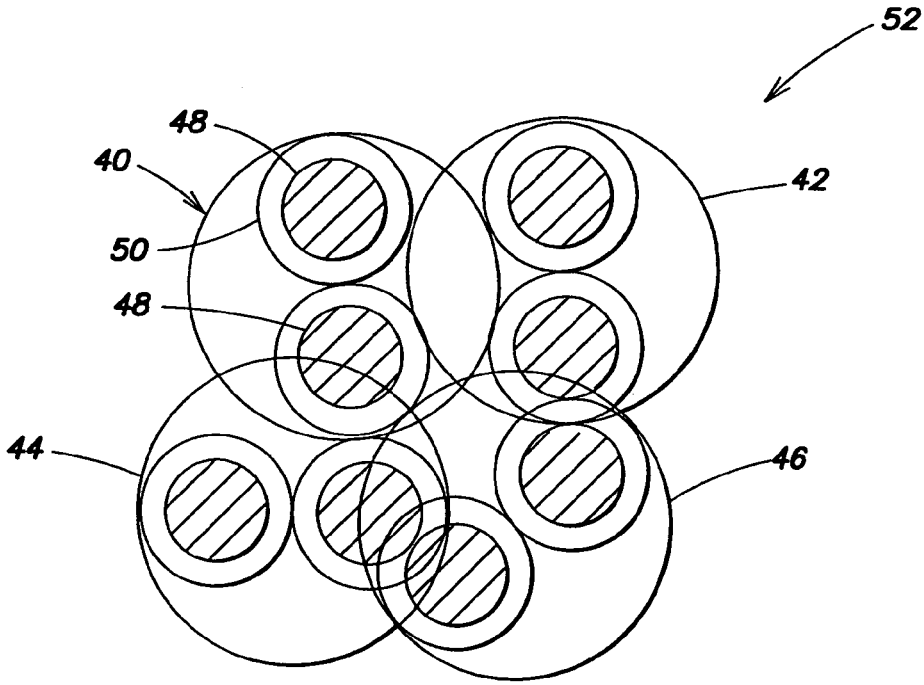
FIG. 2*b* is a schematic cross-sectional diagram of another embodiment of a cable according to aspects of the invention.

According to one aspect of the invention, the two nested pairs 40, 46 may be twisted with shorter twist lay lengths than those of the twisted pairs 42, 44. Twisted pairs with short twist lay lengths are more inclined to nest because, in order to partially compensate for skew, twisted pairs with short twist lay lengths, e.g., twisted pair 40, may be constructed using slightly heavier copper for the metallic conductors 48 and having a slightly larger outer diameter than do the conductors 48*a* of, for example, twisted pair 42. Thus, because the twisted pairs 40, 46 may be larger and heavier than the twisted pairs 42, 44, the twisted pairs 40, 46 may nest. This aspect, combined with the rotational aspect discussed above with reference to FIG. 1*b*, may result in the twisted pairs of the cable being arranged as shown in FIG. 2*b*. Although in the configuration of FIG. 2*b*, all of the twisted pairs may be slightly closer together than in the configuration of FIG. 2*a*, it can be seen that the twisted pairs 40, 46 still maintain a relatively large separation distance between twisted pairs 42 and 44. In addition, in order to control the nesting of twisted pairs 40, 46 and maintain the configuration of FIG. 2*b*, the tension of all of the twisted pairs can be controlled during cabling of the twisted pairs to form the multi-pair cable 52.

As discussed above, the Cat. 6 specification requires a maximum skew between twisted pairs in the cable 52 of 45 ns per 100 m over a frequency range of approximately 0.77 MHz to 250 MHz. In addition, the Cat. 6 specification requires that the minimum crosstalk isolation between twisted pairs of the cable 52 be about 44 dB per 100 m at a test frequency of 100 MHz. For a cable according to the invention having the example twist lay lengths given in Table 2, the minimum crosstalk isolation between twisted pairs may be approximately 46 dB at 100 MHz and the maximum skew may be approximately 39 ns per 100 m for the specified frequency range of 0.77–250 MHz. Thus, using the novel twist lay schemes and pair proximity control of the invention, an unshielded twisted pair cable that meets the Cat. 6 performance requirements may be provided without a central filler or cross-web. This is a significant advantage over prior art cables since a cable that does not require the additional filler may be cheaper to manufacture and more likely to meet plenum requirements.

According to another embodiment of the invention, a four-pair cable, such as illustrated in any of FIGS. 1*a*, 1*b*, 2*a* and 2*b* may be constructed using six aggressive twist deltas. Such an arrangement provides a stable structure because, no matter how the twisted pairs may move during cabling or during use of the cable, the twist delta between each combination of twisted pairs is aggressive and thus crosstalk between twisted pairs may be held to a minimum. Of course, the twist lay lengths should be carefully controlled such that the twist lay length range does not prevent the cable from meeting the Cat. 6 skew requirement. It is to be appreciated that the twist lay lengths used for the twisted pairs of the cable may typically be within a range of approximately 0.250 inches to 1.0 inches. In conventional four-pair cables, such as illustrated in FIG. 1*a*, commonly used twisted deltas may be approximately 30% for adjacent pairs (e.g., pairs 20–22, 20–24, 24–26 and 22–26) and approximately 10% for opposite pairs (e.g., pairs 20–26 and 22–24). As discussed above, an aggressive twist delta may be greater than 15%, and according to aspects of the invention, may be within a range of approximately 15% to 230%. For example, for a cable constructed using the example twist lay lengths given in Table 2, the largest twist delta is approximately 228%.

Figure 3:
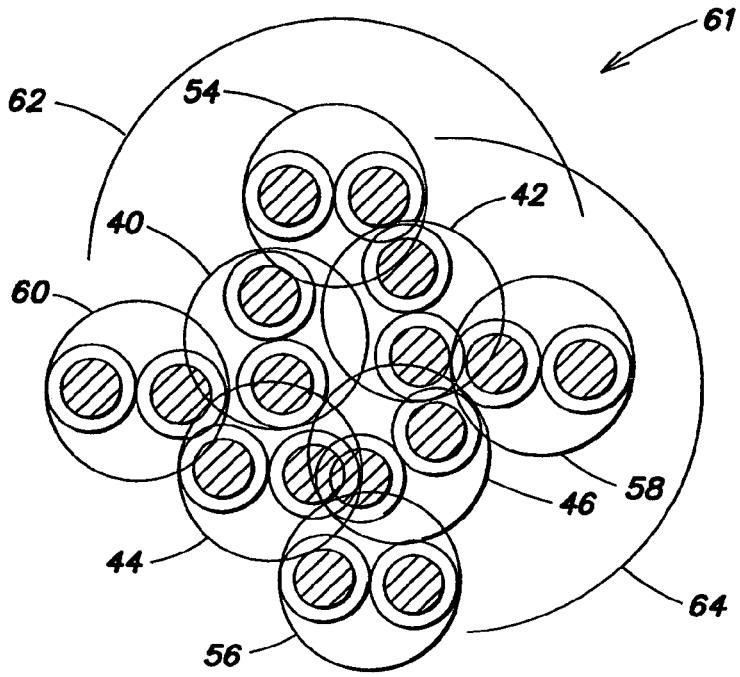
FIG. 3 is a schematic cross-sectional diagram of another embodiment of a cable according to aspects of the invention.

Referring to FIG. 3, there is illustrated another embodiment of a multi-pair cable according to aspects of the invention. In this example, the cable 61 may include a central core formed of four twisted pairs 40, 42, 44, 46 such as in the configuration of FIG. 2*b*. Additional twisted pairs 54, 56, 58 and 60 may be disposed about the central core. A cable such as that illustrated in FIG. 3 may be constructed to meet the Cat. 6 skew requirement because the twist lay length range used for the twisted pairs 54, 56, 58, 60 may not be substantially different from that used for any of the four-pair cables discussed above. The central core formed of twisted pairs 40, 42, 44 and 46 provides a large spatial separation and isolation shield between combinations of the additional twisted pairs. Thus, the twist delta 62 between, for example, twisted pairs 58 and 60, and the twist delta 64 between pairs 54 and 56 may be very small because crosstalk between these pairs is substantially reduced due to the large physical separation of these pairs.

Figure 4:
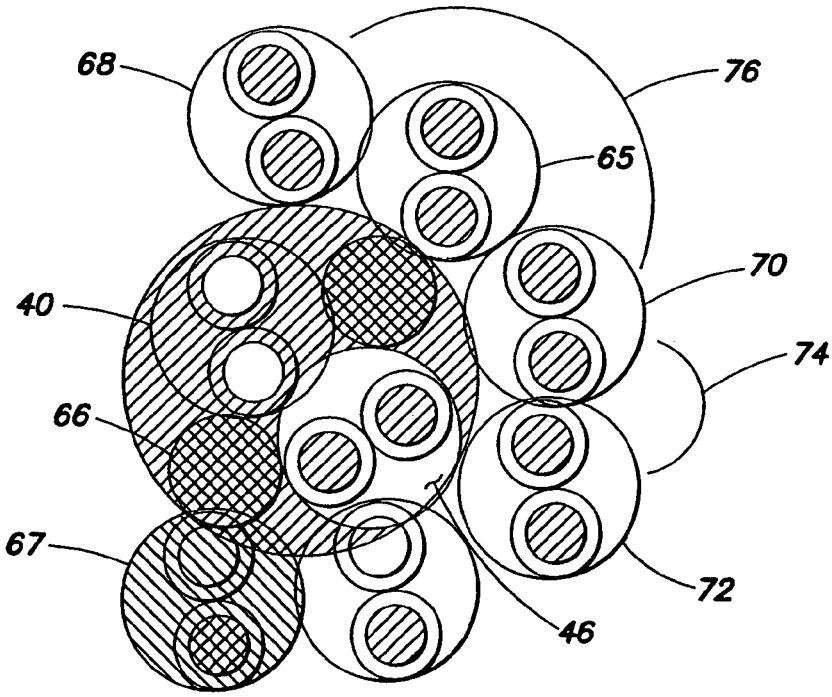
FIG. 4 is a schematic cross-sectional diagram of another embodiment of a cable according to aspects of the invention.

According to another embodiment of the invention, a multi-pair cable may be provided with one or more dielectric fillers that may be used to separate twisted pairs from one another and to add to the structural stability of the cable. For example, referring to FIG. 4, dielectric fillers 66 may be placed in the interstices of nested twisted pairs 40 and 46. Using a combination of dielectric fillers 66 and the aggressive/weak twist lay schemes discussed above, a high pair count cable, for example, an eight or even twenty-five pair cable, can be constructed to meet the Cat. 6 specifications without requiring individual shielding of the twisted pairs. For example, dielectric fillers 66 may provide increased separation distance between, for example, twisted pairs 40 and 65, such that a weaker twist delta may be used between pairs 40 and 65 while still meeting the Cat. 6 requirement for crosstalk between these pairs. Without the dielectric filler 66, pairs 40 and 65 would be adjacent and an aggressive twist delta may have been required between pairs 40 and 65. In a high pair count cable, if too many aggressive twist deltas are used, the cable may no longer meet the Cat. 6 skew requirements because the twist lay length range may become too large. Thus, adding the dielectric fillers 66 facilitates Cat. 6 compliant multi-pair cables by providing a relatively large separation distance between some twisted pairs such that weaker twist deltas can be used between those pairs. The dielectric filler 66 may also aid to further separate pairs, for example, pairs 68 and 70, enabling a weaker than otherwise twist delta to be used between pairs 68 and 70. For another example, twisted pairs 65 and 67 may be separated by a combination of dielectric fillers 66 and twisted pairs 40, 46 such that substantially similar twist lay lengths may used for pairs 65 and 67, thereby enabling a higher pair count within a certain twist lay length range. Strategic placing of the dielectric fillers 66 within the multi-pair cable may thus help to minimize or reduce the number of adjacent pairs, such as pairs 70 and 74, that may use an aggressive twist delta 74 in order to meet the Cat. 6 crosstalk requirements.

Figure 5:
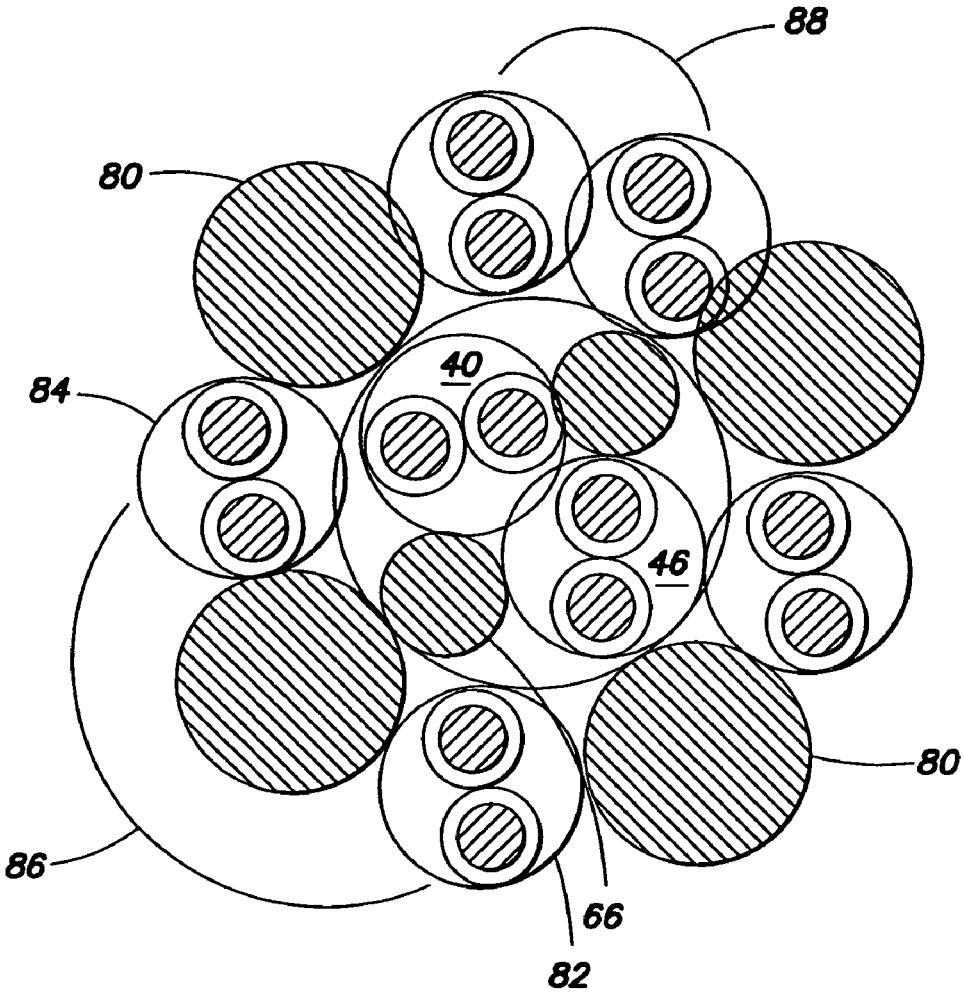
FIG. 5 is a schematic cross-sectional diagram of yet another embodiment of a cable according to aspects of the invention.

Another example of a multi-pair cable including dielectric fillers is illustrated in FIG. 5. In this example, additional dielectric fillers 80 may be provided spaced about the nested twisted pairs 40, 46 and the dielectric fillers 66. The additional dielectric fillers 80 may provide spatial separation between twisted pairs, for example, between twisted pairs 82, 84, such that a twist delta 86 between those pairs may be relatively small. An aggressive twist delta may still be used between adjacent pairs. However, as in the previous examples, the dielectric fillers 80 and 66 may provide sufficient spacing between several pair combinations that a relatively small number of aggressive twist deltas (e.g., five or six) may be used and the cable may meet Cat. 6. skew requirements. Additionally, the dielectric fillers 80 may provide structural rigidity to the cable and may help to maintain the twisted pairs in a desired spatial arrangement.

Various illustrative examples of multi-pair cables according to aspects of the invention have been described above in terms of particular dimensions and characteristics. However, it is to be appreciated that the invention is not limited to the specific examples described herein and the principles may be applied to a wide variety of shielded and unshielded multi-pair cables. The above description is therefore by way of example only, and includes any modifications and improvements that may be apparent to one of skill in the art. For example, any or all of the twisted pairs in any of the configurations illustrated in FIGS. 2*a*–5 may be provided with an individual metallic shield surrounding the twisted pair. Alternatively, any of the cables illustrated in FIGS. 2*a*–5 may be provided with an outer shield disposed around all of the twisted pairs and under the cable jacket. Furthermore, although the illustrated examples of multi-pair cables include four, seven and eight twisted pairs, the invention is not so limited and the principles of the invention may be applied to twisted pair cables including any number of twisted pairs. The scope of the invention should therefore be determined from proper construction of the appended claims and their equivalents.

What is claimed is:

1. A multi-pair cable comprising:

four twisted pairs of insulated conductors including a first twisted pair, a second twisted pair, a third twisted pair and a fourth twisted pair, each having a unique twist lay length, thereby providing six twist deltas between the respective unique twist lay lengths of the four twisted pairs;

wherein the first and second twisted pairs of insulated conductors are nested together and substantially physically separate the third and fourth twisted pairs; and wherein each of the six twist deltas is greater than 15%.

2. The multi-pair cable as claimed in claim 1, wherein a first twist delta between the first and second twisted pairs is greater than a second twist delta between the third and fourth twisted pairs.

3. The multi-pair cable as claimed in claim 1, wherein a diameter of conductors of at least one of the first and second twisted pairs is larger than a diameter of conductors of the third and fourth twisted pairs.

4. The multi-pair cable as claimed in claim 1, further comprising at least one dielectric filler located adjacent the first and second twisted pairs of insulated conductors.

5. The multi-pair cable as claimed in claim 4, wherein at least one of the third and fourth twisted pairs of insulated conductors is spaced apart from the first and second twisted pairs of insulated conductors by the at least one dielectric filler.

6. The multi-pair cable as claimed in claim 4, wherein the at least one dielectric filler separates the third twisted pair and the fourth twisted pair, and wherein a twist delta between the third twisted pair and the fourth twisted pair is less than a twist delta between the first and second twisted pairs.

7. The multi-pair cable as claimed in claim 1, wherein each of the four twisted pairs of insulated conductors comprises a first insulated conductor and a second insulated conductor, and wherein each of the four twisted pairs of conductors comprises an individual metallic shield disposed about the first and second insulated conductors.

8. The multi-pair cable as claimed in claim 1, wherein an arrangement of the four twisted pairs of insulated conductors is such that any crosstalk between each of the four twisted pairs of insulated conductors meets industry standard category six requirements.

9. The multi-pair cable as claimed in claim 1, further comprising a jacket that surrounds the four twisted pairs of insulated conductors.

10. The multi-pair cable as claimed in claim 1, wherein the four twisted pairs of insulated conductors are cabled together in a same direction as a twist direction of the four twisted pairs of insulated conductors to form the multi-pair cable.

11. A multi-pair cable comprising:

a first twisted pair of insulated conductors having a first twist lay length; and a second twisted pair of insulated conductors having a second twist lay length that is shorter than the first twist lay length;

a third twisted pair of insulated conductors; and a fourth twisted pair of insulated conductors disposed such that the third and fourth twisted pairs are separated from one another by the first and second twisted pairs;

wherein the first and second twisted pairs of insulated conductors are nested together to form a central core of the multi-pair cable, the central core defining two interstices; and wherein a difference between the first twist lay length and the second twist lay length is at least 15% of the second twist lay length.

12. The multi-pair cable as claimed in claim 11, further comprising at least one dielectric filler disposed in one of the two interstices of the central core.

13. The multi-pair cable as claimed in claim 12, wherein the third twisted pair of insulated conductors is spaced apart from the first and second twisted pairs of conductors by the at least one dielectric filler.

14. The multi-pair cable as claimed in claim 11, further comprising a third twisted pair of insulated conductors and a fourth twisted pair of insulated conductors, the third and fourth twisted pairs of insulated conductors being disposed at least partially within the two interstices of the central core.

15. The multi-pair cable as claimed in claim 14, wherein an arrangement of the first, second, third and fourth twisted pairs of insulated conductors is such that any crosstalk between each combination of the first, second, third and fourth twisted pairs meets industry standard category six requirements.

16. The multi-pair cable as claimed in claim 11, wherein a diameter of conductors of the first twisted pair of conductors is larger than a diameter of conductors of the third twisted pair of conductors.

17. The multi-pair cable as claimed in claim 11, further comprising a jacket surrounding the first and second twisted pairs of insulated conductors.

18. A multi-pair cable comprising:

a plurality of twisted pairs of insulated conductors including a first twisted pair having a first twist lay length, a second twisted pair having a second twist lay length, a third twisted pair having a third twist lay length and a fourth twisted pair having a fourth twist lay length to comprise six twist deltas between the first, second, third and fourth twisted pairs;

wherein the second twist lay length is at least 15% longer than the first twist lay length thereby providing a first twist delta of the six twist deltas of at least 15% between the first and second twisted pairs of insulated conductors;

wherein the third and fourth twist lay lengths are selected such that the remaining twist deltas of the six twist deltas between the first, second, third and fourth twisted pairs are equal to or larger than the first twist delta; and wherein the first and second twisted pairs are nested together and substantially physically separate the third twisted pair from the fourth twisted pair.

19. The multi-pair cable as claimed in claim 18, wherein a diameter of conductors of at least one of the first and second twisted pairs is larger than a diameter of conductors of the third and fourth twisted pairs.

20. The multi-pair cable as claimed in claim 18, further comprising at least one dielectric filler located adjacent the first and second twisted pairs.

21. The multi-pair cable as claimed in claim 20, wherein at least one of the third and fourth twisted pairs of insulated conductors is spaced apart from the first and second twisted pairs of insulated conductors by the at least one dielectric filler.

22. A multi-pair cable comprising:

an first grouping including a first twisted pair of insulated conductors having a first twist lay length and a second twisted pair of insulated conductors having a second twist lay length;

an second grouping including a plurality of twisted pairs of insulated conductors;

wherein the second twist lay length is at least 15% longer than the first twist lay length thereby providing a first twist delta of at least 15% between the first and second twisted pairs;

wherein the first and second twisted pairs are nested together such that the first and second twisted pairs are in substantial physical contact along substantially an entire length of the multi-pair cable; and wherein first grouping further comprises third and fourth twisted pairs of insulated conductors disposed within two interstices formed by nesting together of the first and second twisted pairs of insulated conductors.

23. The multi-pair cable as claimed in claim 22, wherein the first grouping further comprises a first dielectric filler located in an interstitial space formed by nesting of the first and second twisted pairs of insulated conductors.

24. The multi-pair cable as claimed in claim 23, wherein the plurality of twisted pairs of insulated conductors in the second grouping comprises at least fifth and sixth twisted pairs of insulated conductors, and wherein the second grouping further comprises a second dielectric filler disposed between the fifth and sixth twisted pairs of insulated conductors.

25. The multi-pair cable as claimed in claim 22, wherein the third twisted pair of insulated conductors has a third twist lay length that is at least 15% longer than the second twist lay length.

26. The multi-pair cable as claimed in claim 25, wherein the fourth twisted pair of insulated conductors has a fourth twist lay length that is at least 15% longer than the second twist lay length.

27. The multi-pair cable as claimed in claim 22, further comprising a jacket surrounding the first and second groupings.

28. A method of manufacturing a category six compliant multi-pair cable, comprising:

twisting together a first pair of insulated conductors with a first twist lay length;

twisting together a second pair of insulated conductors with a second twist lay length that is at least 15% greater than the first twist lay length;

twisting together a third pair of insulated conductors with a third twist lay length that is at least 15% greater than the second twist lay length;

twisting together a fourth twisted pair of insulated conductors with a fourth twist lay length that is at least 15% greater than the second twist lay length;

cabling the first and second twisted pairs of insulated conductors together such that the first and second pairs of insulated conductors are nested together in substantial physical contact along substantially an entire length of the multi-pair cable, thereby providing two interstitial spaces; and cabling the third and fourth twisted pairs together with the first and second twisted pairs such that the third and fourth twisted pairs are disposed at least partially within the intersticial spaces provided by nesting together of the first and second twisted pairs.

29. The method as claimed in claim 28, further including a step of disposing a dielectric filler at least partially within one of the two intersticial spaces.

30. The method as claimed in claim 29, wherein the step of cabling includes cabling the first, second and third pairs of insulated conductors such that the third pair of insulated conductors is at least partially separated from the first and second pairs by the dielectric filler.

31. The method as claimed in claim 28, further including a step of twisting and arranging the first, second, third and fourth pairs of insulated conductors such that any crosstalk between each combination of the first, second, third and fourth pairs of insulated conductors is within industry standard category six requirements.

32. A method of manufacturing a category six compliant multi-pair cable, comprising:

twisting together a first pair of insulated conductors with a first twist lay length;

twisting together a second pair of insulated conductors with a second twist lay length that is at least 15% longer than the first twist lay length;

twisting together a third pair of insulated conductors with a third twist lay length that is at least 15% longer than the second twist lay length;

twisting together a fourth pair of insulated conductors with a fourth twist lay length that is at least 15% greater than the second twist lay length; and cabling the first, second, third and fourth pairs of insulated conductors together such that the first and second twisted pairs are nested together, thereby defining two intersticial spaces adjacent abutting sides of the first and second pairs, and the third pair of insulated conductors is disposed adjacent the first and second pairs and on an opposite side of the first and second pairs from the fourth twisted pair.

33. The method as claimed in claim 32, further including a step of disposing a dielectric filler at least partially within one of the two intersticial spaces.

* * * * *